US007963899B2

(12) United States Patent
Papsdorf et al.

(10) Patent No.: US 7,963,899 B2
(45) Date of Patent: Jun. 21, 2011

(54) CONTINUOUS IN-LINE PLEATING APPARATUS AND PROCESS

(75) Inventors: Clifford Theodore Papsdorf, West Chester, OH (US); Patrick John Healey, West Chester, OH (US)

(73) Assignee: The Proctor & Gamble Company, Cincinnati, OH (US)

( * ) Notice: Subject to any disclaimer, the term of this patent is extended or adjusted under 35 U.S.C. 154(b) by 1983 days.

(21) Appl. No.: 09/905,274

(22) Filed: Jul. 13, 2001

(65) Prior Publication Data

US 2003/0069120 A1 Apr. 10, 2003

(51) Int. Cl.
*B31F 1/20* (2006.01)

(52) U.S. Cl. ..... 493/463; 493/373; 493/471

(58) Field of Classification Search ..... 493/463, 493/941, 459, 373, 344, 356, 379, 471, 39, 493/4, 50

See application file for complete search history.

(56) References Cited

U.S. PATENT DOCUMENTS

| | | | | |
|---|---|---|---|---|
| 136,267 | A | | 2/1873 | Reese |
| 654,884 | A | | 7/1900 | Ferres et al. |
| 775,495 | A | * | 11/1904 | Connell |
| 813,593 | A | | 2/1906 | Sexton |
| 1,085,948 | A | | 2/1914 | Smith |
| 1,313,712 | A | | 8/1919 | MacFarland |
| 1,402,584 | A | | 1/1922 | Elrod |
| 1,759,844 | A | | 5/1930 | Gudge et al. |
| 2,001,709 | A | | 5/1935 | Davidson |
| 2,084,362 | A | | 6/1937 | Visscher et al. |
| 2,164,702 | A | * | 7/1939 | Davidson |
| 2,196,006 | A | | 4/1940 | Benedict |
| 2,314,757 | A | * | 3/1943 | Benedict |
| 2,335,313 | A | | 11/1943 | Rowe et al. |
| 2,494,431 | A | * | 1/1950 | Eckstein ..... 425/396 |
| 2,655,978 | A | | 10/1953 | Gonda et al. |
| 2,931,748 | A | | 4/1960 | Muller |
| 2,986,076 | A | | 5/1961 | Flint et al. |
| 3,038,718 | A | | 6/1962 | Balsam |
| 3,178,494 | A | | 4/1965 | Tisdale |
| 3,205,791 | A | * | 9/1965 | Goodfellow et al. |
| 3,348,458 | A | * | 10/1967 | Tipper |
| 3,383,449 | A | * | 5/1968 | Moller |
| 3,676,263 | A | | 7/1972 | Tisdale |
| 3,800,676 | A | * | 4/1974 | Levers et al. ..... 493/44 |
| 3,849,526 | A | | 11/1974 | Muller et al. |
| 3,852,007 | A | | 12/1974 | Levers et al. |
| 3,928,105 | A | | 12/1975 | Holden |
| 3,948,712 | A | | 4/1976 | Stannard |
| 3,998,140 | A | | 12/1976 | Andre |
| 4,170,347 | A | | 10/1979 | Lewis |
| 4,181,070 | A | | 1/1980 | Robbins et al. |

(Continued)

FOREIGN PATENT DOCUMENTS

| | | |
|---|---|---|
| DE | 583894 | 9/1933 |

(Continued)

*Primary Examiner* — Sameh H. Tawfik
(74) *Attorney, Agent, or Firm* — David K Mattheis; Peter D Meyer

(57) ABSTRACT

A web pleating apparatus comprising a first series of converging elongate spaced protuberances and a second series of elongate spaced protuberances converging in the machine direction. The first series of protuberances and said second series of protuberances interleave in the Z-direction. The interleaved protuberances are capable of folding a pleatable web into a generally pleated pattern of machine direction pleats upon contact with said first and second series of protuberances.

26 Claims, 5 Drawing Sheets

U.S. PATENT DOCUMENTS

| | | | | | |
|---|---|---|---|---|---|
| 4,189,511 | A | * | 2/1980 | Levers et al. | 428/167 |
| 4,252,591 | A | * | 2/1981 | Rosenberg | |
| 4,507,107 | A | * | 3/1985 | Berger | 493/44 |
| 4,517,714 | A | | 5/1985 | Sneed et al. | |
| 4,626,307 | A | | 12/1986 | Cherkas et al. | |
| 4,747,816 | A | | 5/1988 | Matsuyama et al. | |
| 4,768,575 | A | | 9/1988 | Bruner et al. | |
| 4,777,005 | A | | 10/1988 | Miller | |
| 4,904,332 | A | | 2/1990 | McKeown | |
| 4,940,500 | A | | 7/1990 | Tadokoro et al. | |
| 5,185,052 | A | * | 2/1993 | Chappell et al. | 493/463 |
| 5,725,784 | A | | 3/1998 | Geibel et al. | |
| 5,919,122 | A | | 7/1999 | Geiger et al. | |

FOREIGN PATENT DOCUMENTS

| | | |
|---|---|---|
| DE | 692543 | 5/1940 |
| GB | 376846 | 7/1932 |
| GB | 541015 | 11/1941 |
| WO | WO 99/47347 | 9/1999 |

* cited by examiner

CONTINUOUS IN-LINE PLEATING APPARATUS AND PROCESS

FIELD OF THE INVENTION

The present invention relates to an in-line apparatus for pleating a web. The pleated web may be useful for the manufacture of pleated filter elements.

BACKGROUND OF THE INVENTION

Glass micro fiber media consisting of a laminate of micro glass paper and polyester nonwoven can filter contaminants such as microbiological cysts and asbestos from drinking water. This material can be formed into a pleated structure to increase useful surface area for filtration. However, forming pleats quickly and reliably in glass micro fiber media challenges existing pleating equipment. Glass micro fiber media material tends to have memory and is highly elastic in bending and resists plastic deformation. Material that bends elastically will generally not take a set when folded and can spring back to its original shape if not controlled properly. Glass micro fiber media can also be delicate to handle and can be damaged if strained excessively. A filter requiring a small pleat height, for example, less than 0.25 inches (0.64 centimeter), creates further challenges for manufacturing due to geometrical and physical constraints.

In a pleating process, forces can act upon a web in primarily three directions. The direction of travel of the web is generally known in the art as the machine direction (MD). The direction orthogonal and coplanar to web motion is generally known as the cross-machine direction (CD). The direction orthogonal to both the MD and CD is generally known as the Z-direction.

Two commercial approaches for creating pleats in glass micro fiber media webs are commonly used. The approaches are the pusher bar and rotary score pleaters. Both pusher bar and rotary score pleaters create pleats parallel to the CD of a web.

The pusher bar, also known in the art as a blade pleater, uses a reciprocating blade to produce a CD fold as the web travels in the MD. This method of forming pleats is relatively slow and requires multiple machines or CD lanes to achieve high throughput.

A rotary score pleater applies evenly spaced CD scores. The CD scored web is driven by nips on a slow MD conveyor that bends the web about the scores forming CD folds. A rotary score pleater can produce pleats faster than the pusher bar pleater, however, the individual folds are not controlled during the pleating process. In addition, webs that bend elastically run with low reliability due to the inability to positively control Z-direction movement of the pleated web.

In addition to conventional CD pleating, MD pleating methods are described in the art. Generally these MD processes were intended for more plastic materials that take a set when folded, tolerate higher strain, and have larger pleat heights.

An example of an MD pleater is described in Rosenburg, U.S. Pat. No. 4,252,591. This method constrains the web between converging "V"-shaped guides and chains, where the chains pull the web though the guides. These chains ride inside the "V" and the web is sandwiched between the chains and the guides. This method is not well suited for small pleat heights due to the relatively large chain cross-section required to generate sufficient force to drive the web. Secondly, this method produces poor pleats in a web that bends elastically because the weight of the chains must hold the web into the guides. A web that bends elastically can lift the chains out of the guides and prevent folding. Lastly, the web scoring process disclosed employs male rings that press the web into female grooves. This method of scoring produces excessive strain on the web and can lead to catastrophic failure. Moll, German Patent DE 583,894, attempts to minimize strain in a web during the formation of longitudinal corrugations by employing soft rollers. Moll does not address control of a web that bends elastically. Practically, soft rollers cannot fully press the longitudinal corrugations of a web that bends elastically into the grooves of a forming plate unless the longitudinal corrugations are very shallow. Also the pleats are not controlled in the Z-direction between successive rollers.

MacFarland, U.S. Pat. No. 1,313,712, Rowe, U.S. Pat. No. 2,335,313, and Jackson, Great Britain Patent No. GB 376,846, disclose methods for folding pleats in a web between converging belts. These methods are not practical for small pleats because this requires the use of an impractically small belt. Also, these methods cannot control a web that bends elastically because the belts are not able to resist the Z-direction spring force of the compressed pleated web.

U.S. Pat. Nos. 654,884; 813,593; 1,402,548; 1,759,844; 2,084,362; 2,164,702; 2,196,006; 2,314,757; 2,494,431; 2,986,076; 3,038,718; 3,205,791; 3,348,458, European Patent No. WO 99/47347, and British Patent No. GB 541,015 disclose systems that pull a web though a converging set of blades or guides. None of these teach driving a web during folding with blades. The friction created by pulling a web through the process can create excessive strain and damage web fibers. U.S. Pat. Nos. 136,267; 775,495; and 5,185,052 are representative of systems that form pleats or corrugations by running a material between progressive rollers. These systems have difficulty controlling the folds of a web that bends elastically between successive sets of rolls.

The present invention provides an improved apparatus for producing pleats in the MD direction, at high speed, in a delicate web that bends elastically. This process is likewise able to produce pleats in materials that easily take a set when folded or are insensitive to strain.

SUMMARY OF THE INVENTION

The present invention relates to a web pleating apparatus having a mutually orthogonal machine direction, a cross machine direction and a Z-direction. The apparatus comprises a first series of elongate spaced protuberances converging in the machine direction, and a second series of elongate spaced protuberances converging in the machine direction. The first series of protuberances and the second series of protuberances interleave in the Z-direction. Additionally, the first series and the second series of interleaved protuberances are capable of folding a pleatable web into a generally pleated pattern of machine direction pleats upon contact with the first and second series of protuberances.

The present invention also relates to a method for forming a pleatable web comprising the steps of providing a pleatable web, scoring the pleatable web in the machine direction, transporting the scored web relative to a first series and second series of machine direction converging elongate spaced protuberances interleaved and spaced in the Z-direction, and, folding the scored web with the interleaved first series and second series of converging protuberances. The interleaved converging protuberances pleat the pleatable web in the machine direction.

The present invention also relates to a filter which comprises a pleated web formed by providing a pleatable web, scoring the pleatable web, transporting the scored web relative to a first and second series of interleaved converging elongate spaced protuberances, and, folding the scored web with the interleaved first and second series of converging protuberances wherein the interleaved converging protuberances pleat the pleatable web.

BRIEF DESCRIPTION OF THE DRAWINGS

While the specification concludes with claims which particularly point out and distinctly claim the present invention, it is believed that the present invention will be better understood from the following description of preferred embodiments, taken in conjunction with the accompanying drawings wherein:

DETAILED DESCRIPTION OF THE INVENTION

The present invention is related to an in-line pleating process to manufacture pleated webs for filter elements useful for water filtration products. The pleated elements can be a component of a disposable replacement filter cartridge. The pleated element can be responsible for the removal of microbiological cysts, such as giardia and cryptosporidium, as well as suspended solids, etc. Other non-limiting uses for pleated webs include oil and air filtration and structural corrugation. Exemplary, but non-liming, materials that can be supplied in continuous web or discontinuous sheet form and pleated in the machine direction by the present invention include wet or dry laid papers (i.e. glass, cellulose, quartz, asbestos, carbon, metal, and synthetic polymer fibers), woven natural fabrics (i.e. cotton, silk, and wool), polymeric wovens (multifilament or monofilament) and melt blown, spunbonded, and flash spun nonwovens (i.e. polyamide, polyaramid, polyester, polyethylene, polypropylene, polytetrafluoroethylene, and polyvinyl chloride), felts, needle felts, perforated metals and plastics, metal or plastic screens and meshes, metal or plastic sheets or foils, and combinations thereof. Loose filter media such as granules, powders, or fibers can also be combined to a web substrate and pleated. Exemplary, but non-limiting, loose media that can be combined with a web are carbon granules, diatomite, expanded pearlite, sand, glass, carbon, molecular sieves, and cellulose fibers. However, the web can generally consist of any material that can be folded into the desired pleated shape without failure due to exceeding the ultimate strength of the material during bending.

Figure 1:
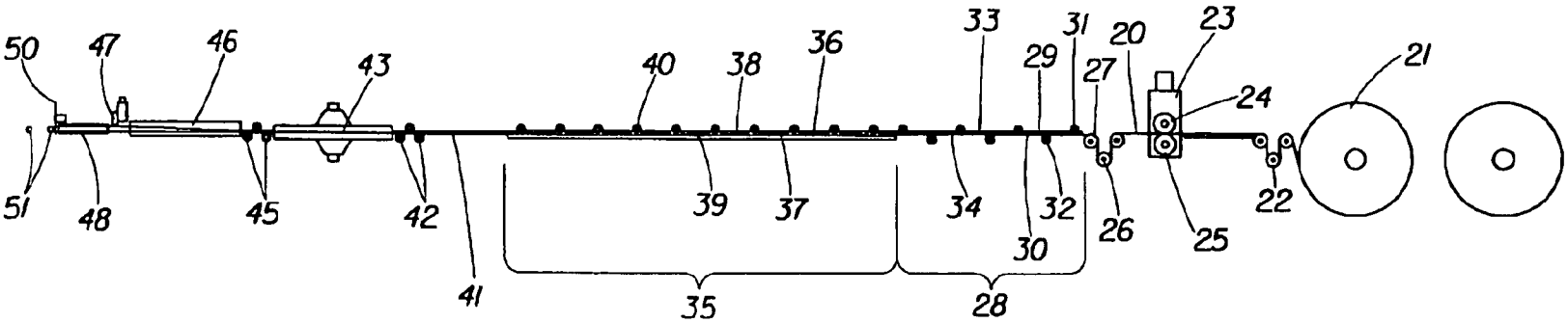
FIG. 1 is an elevational view of a preferred embodiment of the web pleating apparatus in accordance with the present invention.
Figure 2:
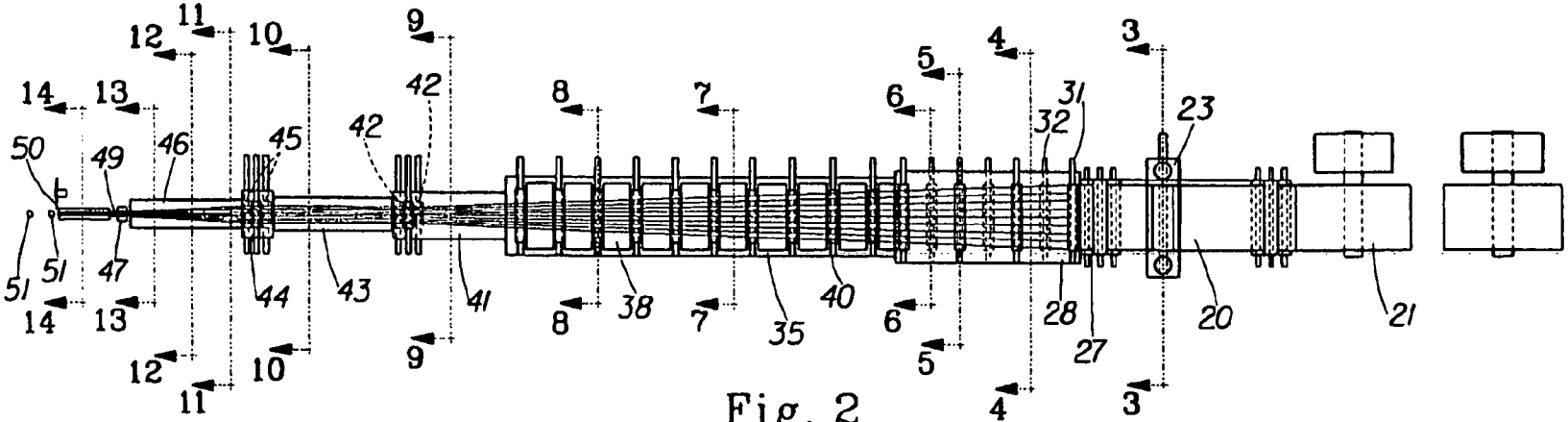
FIG. 2 is a plan view of a preferred embodiment of the web pleating apparatus.

Referring to FIGS. 1 and 2, a flat web 20 can be supplied in continuous web form by unwinding the flat web 20 from roll 21. A tension control device 22, such as a dancer that controls torque by a braking action, can be used to maintain constant tension from the roll 21. Alternatively flat web sheets 20*a* can be inserted as individual sheets that move in the MD in a discontinuous manner.

The flat web 20 is fed into scoring rolls 23. The scoring rolls 23 comprise an upper roll 24 and a lower roll 25 that form a nip therebetween. The flat web 20 is inserted between rolls 24 and 25. Upper roll 24 and lower roll 25 are driven so that the surface speeds of scoring rolls 23 equals the speed of flat web 20. Tensioning device 26 can be used to provide feedback to the drive of the scoring rolls 23 to provide a constant tension in web 20 between scoring rolls 23 and driven pleat forming board 28. Entrance idler 27 preferably is inserted to transport web 20 to the entrance of driven pleat forming board 28. Entrance idler 27 can generally have a convex, or crowned, surface to prevent wrinkling of web 20 due to potential unequal path lengths in the MD of web 20 as it enters driven pleat forming board 28.

Figure 3:
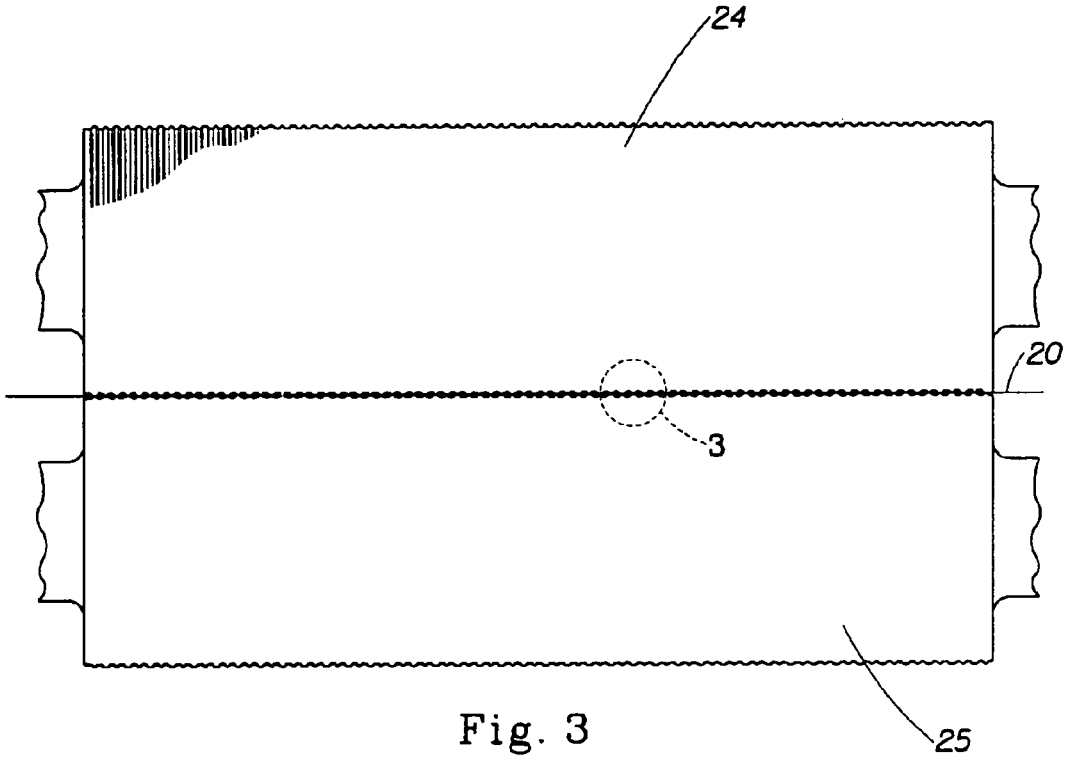
FIG. 3 is a cross-sectional view of the scoring rolls taken along line 3-3 of FIG. 2.

FIG. 3 shows a cross-sectional view of upper roll 24 and lower roll 25. As a non-limiting example, upper roll 24 can be loaded against lower roll 25 by force from a pneumatic cylinder or other method of supplying force as would be known to one skilled in the art. The distance between the axis of upper roll 24 and lower roll 25 is preferably constrained to maintain a fixed gap between adjacent surfaces of upper roll 24 and lower roll 25. This gap is preferably less than the thickness of the flat web 20.

Figure 3A:
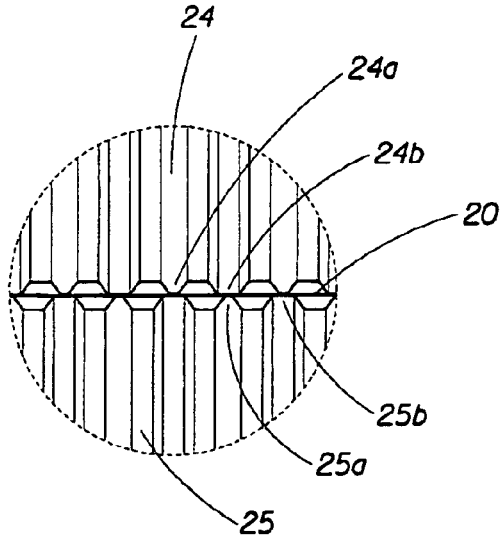
FIG. 3*a* is an expanded view of the region labeled 3*a* of FIG. 3.

FIG. 3*a* shows an enlarged detail of the working surface of scoring rolls 23. Flat web 20 is compressed between alternating radiused teeth 24*a*, 25*a* and flats 24*b*, 25*b* that circumscribe the face of rolls 24, 25. Teeth 24*a*, 25*a* can have any surface that provides an effective score line on the web. For example, teeth 24*a*, 25*a* can be paralellpiped, tapered, semicylindrical, or pyramidal. Flats 24*b*, 25*b* provide a mating surface for teeth 24*a*, 25*a* located on the opposite roll. Tooth 24*a* compresses web 20 against the center of flat 25*b* and tooth 25*a* compresses web 20 against the center of flat 24*b*. This results in web 20 having a score line with an inner apex pressed in the upper surface corresponding to 24*a* and 25*b* and a score line with an inner apex pressed in the lower surface corresponding to 25*a* and 24*b*. Mating radiused teeth 24*a*, 25*a* and flats 24*b*, 25*b* are preferably equally spaced and alternate orientation across the face of rolls 24, 25 resulting in a plurality of continuous and equally spaced parallel alternating upper and lower score lines across the width of web 20. Alternating upper and lower score lines predispose the web to fold with less effort upwards and downwards respectively. As a result, the scored flat web 20 is predisposed to be alternately folded to form pleats. However, it would be known to one skilled in the art that scoring is not required for every type of web material. It would be also known to those of skill in the art that teeth 24*a*, 25*a* and flats 24*b*, 25*b* can be unequally spaced, discontinuous, and may be aggregated in any combination on either roll 24, 25.

Referring to FIGS. 1 and 2, the scored web 20 next enters the driven pleat forming board 28 where the pleat folds are gradually formed in the machine direction. A plurality of pleat forming blades 29, 30 guide the inner apex of each pleat fold from above and below. As shown in FIG. 2, pleat forming blades 29, 30 are preferably continuous singular linear blades, collectively elongate and span the length of the driven pleat forming board 28. However, it would be known to one skilled in the art to use collinear or non-collinear, collectively elongate or non-collectively elongate surfaces to form pleats. Pleat forming blades 29, 30 initially engage web 20 at a spacing equal to the desired pleat height corresponding to the spacing of the score lines. Blades 29, 30 generally converge down stream toward the MD centerline of web 20. The point where overlap and interleaving of blades 29, 30 begins is generally known as the inlet. The last occurrence of contact of web 20 with blades 29, 30 is generally known as the outlet.

Pleat forming blades 29, 30 alternate above and below the web 20 across the width of the web 20 corresponding to the alternating upper and lower score lines. Upper blades 29 correspond to score lines created by upper teeth 24*a* and lower blades 30 correspond to score lines created by lower teeth 25*a*. Web 20 is controlled and constrained into a pleated shape when traveling in the MD by upper pleat forming blades 29 and lower pleat forming blades 30. Lower pleat forming blades 30 preferably remain level over their entire span. The upper pleat forming blades 29 are in a plane that declines in the Z-direction as the blades 29 extend downstream in the MD. The intersection of the declined plane of the upper blades 30 and the level plane of the lower blades 30 is a CD line. Each of the lower blades 30 converges to a downstream point located on the web MD centerline. Likewise each of the upper blades 29 converges to another downstream point on the web MD centerline. This point is located on the line orthogonal to the horizontal plane that intersects the lower blade convergence point. The angle between each successive pair of lower blades 30 is bisected by the horizontal projection of the upper blades 29. At the inlet of the board there is a clearance in the Z-direction between the edge of the lower blades 30 and upper blades 29. As the upper blades 29 follow the declining plane downstream, the upper blades 29 gradually interleave in the Z-direction with the lower blades 30.

At the entrance of the driven pleat forming board 28, the vertical clearance of upper blades 29 and lower blades 30 is approximately equal to the web thickness and provides sufficient clearance so web 20 can be threaded between blades 29, 30. At the exit of driven pleat forming board 28, the upper blades 29 interfere with the lower blades in the Z-direction to constrain the pleats of web 20 between blades. Clearance in the Z-direction is provided to allow for the thickness of the web 20 and additional clearance is provided to minimize friction between blades 29, 30 and web 20. The paths of blades 29, 30 maintain a nearly constant distance between upper and lower blade endpoints at cross-sections perpendicular to the web 20. The outer pleat forming blades 29, 30 of the board are generally longer than the center pleat forming blades 29, 30. Hence, the length of driven pleat forming board 28 should be sized so web 20 behaves elastically when strained in the MD due to the unequal path length. The MD strain on outer fibers is generally larger in a short MD pleat forming board 28 than in a long MD driven pleat forming board 28 because the path lengths are more nearly equal on the longer driven pleat forming board 28. If driven pleat forming board 28 is not long enough in the MD, the stress on the outer fibers of web 20 can exceed the yield stress, causing the web to plastically deform. If the ultimate web strength is exceeded, web 20 can fail.

Figure 4:
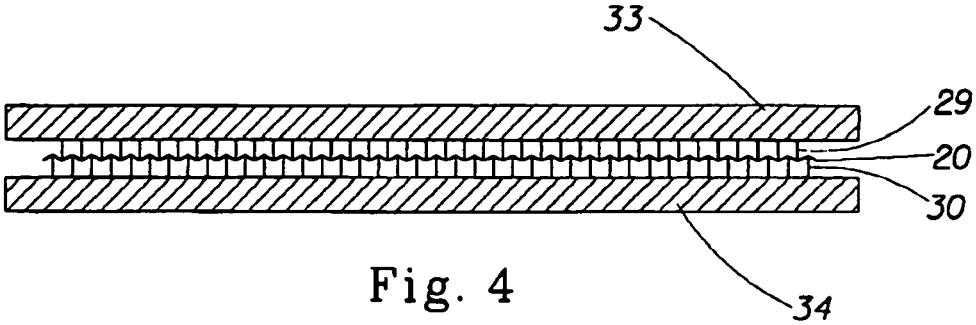
FIG. 4 is a cross-sectional view of a driven pleat forming board taken along line 44 of FIG. 2.

FIG. 4 shows a cross-section of driven pleat forming board 28. Upper pleat forming blades 29 are supported by upper plate 33 and the lower pleat forming blades 30 are supported by lower plate 34. Preferably, each lower pleat forming blade 30 lines up with a corresponding lower score line in the web 20 and each upper pleat forming blade 29 lines up with the corresponding upper score line of web 20. Web 20 is constrained between the edges of pleat forming blades 29, 30 and shallow alternating folds have begun to form.

Figure 5:
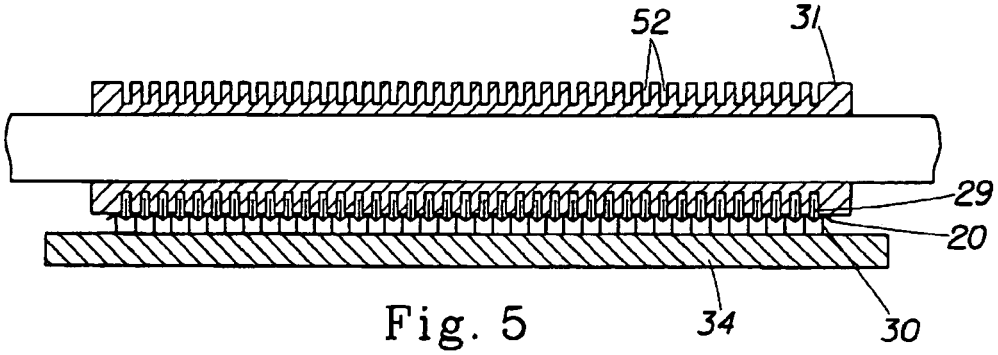
FIG. 5 is a cross-sectional view of a driven pleat forming board driven from above and taken along line 5-5 of FIG. 2.
Figure 6:
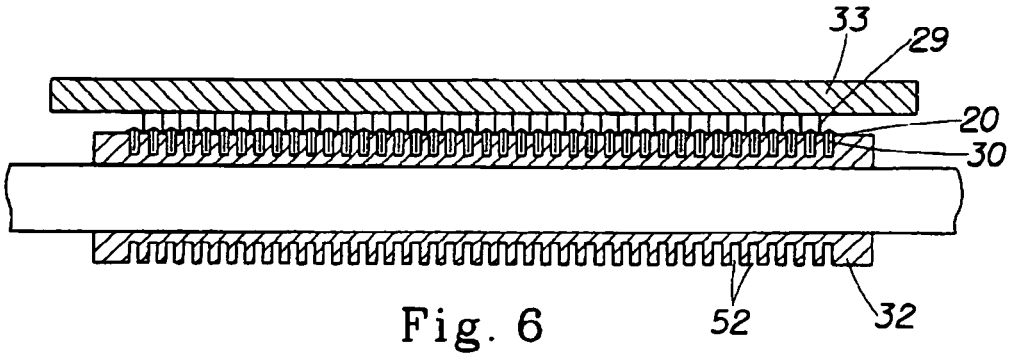
FIG. 6 is a cross-sectional view of a driven pleat forming board driven from below and taken along line 6-6 of FIG. 2.

FIG. 5 shows a cross-section of the driven pleat forming board taken at the center of an upper drive roll 31. The driven elements need not be limited to rollers, for example, drive belts or feet in traction with the web can be used. Upper roller 31 has equally, or unequally, spaced clearance grooves 52 around the periphery of roller 31. A clearance groove 52 allows upper roll 31 to extend beyond upper blade 29 and contact the upper surface of web 20. Web 20 is driven due to a differential friction between roll 31 and blade 30. Blades 29, 30 are preferably made from a smooth material with a low coefficient of friction. The surface of roll 31 is preferably a compliant material with a high coefficient of friction against the web, for example, rubber or urethane. The axis of roll 31 can be held horizontal and the drive roll 31 loaded by a normal force against web 20 to insure that roll 31 remains in traction with web 20. Alternatively, or additionally, as shown in the cross-sectional view of FIG. 6, lower drive roll 32 may engage the lower surface of the web 20. Drive rolls 31, 32 are driven at a surface speed to match the surface speed of the transported web. Drive rolls 31, 32 provide energy to the web 20 to drive it through folding board 28.

Alternatively, web 20 may be pulled through driven pleat forming board 28 without drive rolls 31, 32. However, pulling web 20 imparts a high frictional force to web 20 resisting motion. This frictional force can create high stress in web 20, and may lead to plastic deformation or failure. Thus, drive rolls 31, 32 are preferably distributed along the length of driven pleat forming board 28 at sufficient spacing to keep strain in the web due to frictional forces at an acceptably low level.

The critical control angle (CCA) is the maximum angle at which the pleated web 20 will tolerate a MD discontinuity in one set of blades and not come out of the remaining blades. If the pleat angle is above the CCA, the pleat may not remain controlled by a single set of blades and one side of the forming pleats may slide off due to lateral compressive forces in the media. For exemplary purposes only, the CCA has been found to range from approximately 100 to 150 degrees for several glass micro fiber media. However, this angle depends upon the material properties of the selected web. Generally, when web 20 has a fold angle greater than the CCA, the upper and lower blades 29, 30 should maintain continuous contact with the web 20 to retain control of the pleats and correctly form the final pleated web product. After the fold angle becomes less than the CCA, it is possible to use discontinuous upper and lower blades 29, 30. This can allow for overall design simplification, for instance, no longer requiring grooves on the rolls, and allowing all rolls to be loaded from one side and turn the same direction. Of course, driven pleat forming board 28 can be continued for the full MD length of the system.

Figure 7:
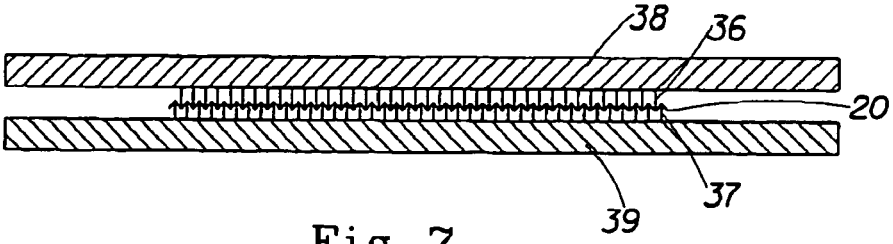
FIG. 7 is a cross-sectional view of a convergence board taken along line 7-7 of FIG. 2.

FIG. 2 shows the convergence driven folding board 35 that continues the gradual pleating process initiated by the driven pleat forming board 28. FIG. 7 shows a cross-sectional view of the convergence driven folding board 35 taken at an upper plate 38. Convergence driven folding board lower blades 37 are preferably collinear to each of the lower blades 30. These can be continuous extensions of lower blades 30 or there can be a gap between convergence driven folding board lower blades 37 and lower blades 30. Preferably, convergence driven folding board lower blades 37 are continuous in the MD for the entire length of convergence driven folding board 35. Convergence driven folding board lower blades 37 can be made discontinuous to provide access for lower drive rolls. The partially pleated web 20 is constrained between convergence driven folding board lower blades 37 and convergence driven folding board upper blades 36. Convergence driven folding board upper blades 36 are preferably collinear to upper blades 29. Convergence driven folding board upper blades 36 are preferably discontinuous to allow clearance for upper drive rolls 40. Convergence driven folding board upper blades 36 can alternatively be made continuous for the length of board 35. Web 20 is controlled from below by convergence driven folding board lower blades 37 and from above by convergence driven folding board upper blades 36. Convergence driven folding board lower blades 37 are supported by lower plate 39. Convergence driven folding board upper blades 36 are supported by upper plate 38. The height of the upper plate 38 above the lower plate 39 is preferably set by spacers. The upper plate 38 generally follows a decline as with upper plate 33. Upper plates 38 can be supported only by web 20, however, this can create additional friction. Drive rolls 40 are preferably used to overcome the friction between web 20 and convergence driven folding board upper and lower blades 36, 37 to drive web 20 through convergence driven folding board 35.

Figure 8:
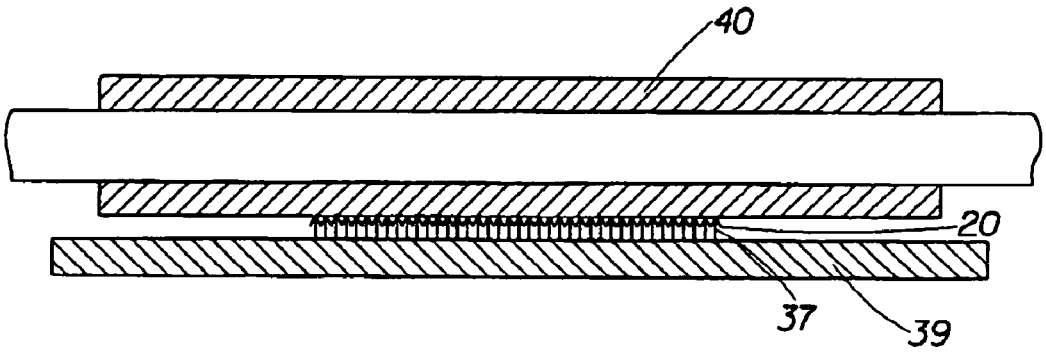
FIG. 8 is a cross-sectional view of a convergence board driven from above taken along line 8-8 of FIG. 2.

FIG. 8 shows a cross-section of convergence driven folding board 35 taken at the axis of one of the drive rolls 40. Pleated web 20 is supported and controlled by convergence driven folding board lower blades 37. Upper drive roll 40 has traction with the top of web 20. Discontinuous convergence driven folding board upper blades 36 are not present near drive roll 40, allowing a flat face (no groove) roll design to engage web 20. The face of drive roll 40 has a higher coefficient of friction with web 20 than convergence driven folding board lower blades 37. Drive roll 40 is preferably driven to match the surface speed of web 20 and drive web 20 through folding board 28 due to the differential friction present. Drive rolls 40 are preferably spaced sufficiently close together to maintain the strain in web 20, caused by friction with the blades, at an acceptably low level.

Because outer convergence driven folding board lower blades 37 are skewed in the CD and are not perpendicular with the drive roll 40, the shear component of the roll traction can tend to pull web 20 out of the outer convergence driven folding board lower blades 37. An alternative to the full width drive roll 40 is to drive the web 20 with a narrow roll that does not cover the outer four or so pleats on each side. The convergence driven folding board upper blades 36 can be continued along these outer pleats adjacent to the drive rolls 40. It is also possible with materials that bend more plastically to replace the convergence driven folding board upper blades 36 with floating dead plates that hold the pleats into the convergence driven folding board lower blades 37.

As would be known to one of skill in the art that boards 28, 35 can have many alternative configurations. Driven rolls 31, 32, 40 can be located on either side of web 20. Blades 29, 30, and convergence driven folding board blades 36, 37 can be continuous or discontinuous on either side of web 20 as desired for the web material chosen. It is also possible for convergence driven folding board 35 to be used for the full length of pleating without the need for board 28 if web 20 is not highly elastic in bending. Likewise, board 28 can extend the full length of pleating. Optionally, board 35 can precede board 28 in the process, if desired.

Figure 9:
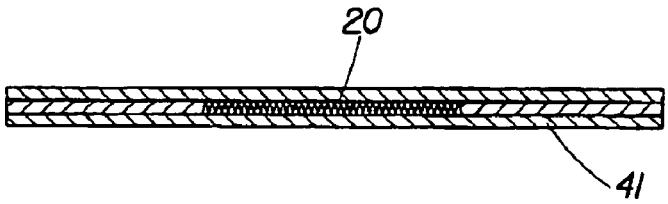
FIG. 9 is a cross-sectional view of a convergence tunnel taken along line 9-9 of FIG. 2.

FIG. 9 shows a cross-section of web 20 in convergence tunnel 41 located down stream of convergence driven folding board 35. The convergence tunnel 41 is a smooth walled tunnel that constrains the pleated material from four sides so that the pleats cannot pop out or loose their form. During convergence, the clearance between the sidewalls of tunnel 41 decreases and the clearance between the upper and lower walls increases as web 20 moves downstream. Once web 20 reaches the desired width, tunnel 41 generally maintains a constant width. Since the final filter product is generally cylindrical, the convergence width of the pleated web 20 is approximately equal to the outer diameter circumference of the final cylindrical product. Drive rolls 42 in the constant width section of the tunnel 41 impart energy to the pleated web 20 to pull it though the tunnel 41. Drive rolls 42 push web 20 against the respective upper and lower tunnel walls. Convergence driven folding board upper blades 36 can extend out of convergence driven folding board 35 and into tunnel 41 and preferably extend the length of convergence tunnel 41 ending prior to drive roll 42. Convergence driven folding board upper blades 36 preferably continue at a constant convergence angle in the CD and then straighten out and run parallel at the constant width portion of tunnel 41. Optionally, convergence driven folding board lower blades 37, or a combination of convergence driven folding board upper blades 36 and convergence driven folding board lower blades 37, can extend into convergence tunnel 41.

Figure 10:
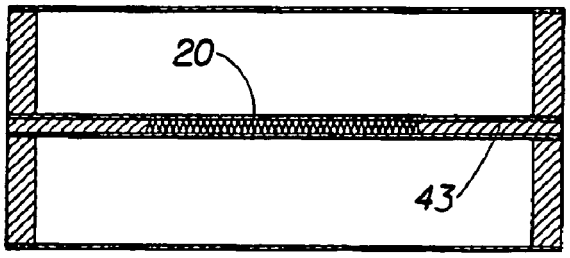
FIG. 10 is a cross-sectional view of a heated tunnel taken along line 10-10 of FIG. 2.
Figure 11:
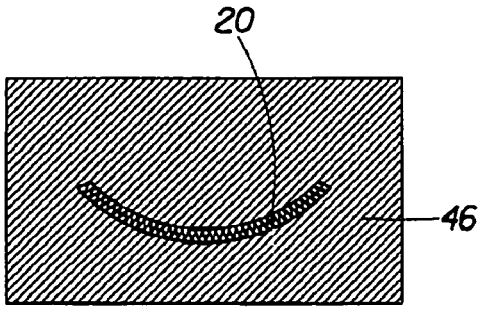
FIGS. 11-13 are successive cross-sectional views of a cylindrical forming tunnel taken along lines 11-11, 12-12, and 13-13 of FIG. 2 respectively; and, FIG. 14 is a cross-sectional view of a seamed cylindrical product in a cooling tube and taken along line 14-14 of FIG. 2.
Figure 12:
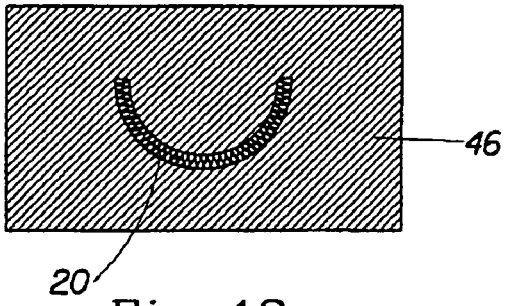
Figure 13:
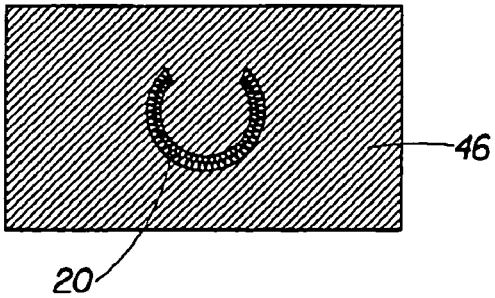

Depending on the web material, once the width of the pleated web 20 is converged, the web 20 is optionally, but preferably, heated to soften the web 20 folds so they will take a set when cooled to hold the web 20 in a pleated shape. Heat can be transferred to the web by convection, radiation, including infra red radiation, or conduction. Preferably, heating is done by convection using hot air. Referring to FIG. 10, the converged web 20 is preferably constrained on four sides by heat tunnel 43. The width of the pleated web 20 is controlled so that the pleats have a slight spacing between folds. Such spacing can provide an even heat transfer to the pleats and prevents adjacent edges from melting together. Heating can also occur at any point in folding driven pleat forming board 28, convergence driven folding board 35, and convergence tunnel 41 or at any point in the pleating process described supra. Additionally, blades can be present within heat tunnel 43.

FIG. 10 shows a cross-section of converged web 20 inside of the heat tunnel 43. Hot air can be supplied from above and below web 20. The temperatures of the upper and lower hot air can be independently controlled, allowing the natural curl of the final cooled heat set pleated web 20 to be predetermined. Optionally, a cooling section is located downstream from heat tunnel 43. Optionally the width of the web can be reduced to compress the pleats past heat tunnel 43. However, web 20 should be generally constrained during cooling.

The post-heating drive tunnel 44 uses drive rolls 45 to drive the pleated web 20 from heat tunnel 43 to cylinder former 46. These additional drive rolls 45 are in traction with web 20 and can provide additional driving force to the web to counter the friction between web 20 and various stationary guides in contact with web 20. To better counter friction, additional drive rolls can optionally be added to other areas of the process such as heat tunnel 43, cylinder former 46, and cooling tube 48.

Referring to FIGS. 10-14, the pleated web 20 is preferably passed through cylinder forming tunnel 46 that gradually, or progressively, forms the flat web 20 into a cylindrical web 20. The cross-section of the cylinder forming tunnel 46 is in the shape of an arc (arcuate) with constant arc length. Cylinder forming tunnel 46 constrains the periphery of the pleated web 20 to form an arcuate cross-section. The radius of the arc is gradually reduced from the entrance of the tunnel to the exit of the tunnel. In addition to cylindrical products, various other closed or open cross-sectional shapes can be obtained such as flat pleat panels, triangles, squares, higher order polygons, and various curved shapes. Web 20 can also be compressed or released in cylinder forming tunnel 46. Blades may also be present in cylinder forming tunnel 46.

If a closed cross-section is desired, a continuous seam 49 can be made in cylindrical web 20 to join the edges together and create a closed cylindrical web 20 that is a continuous tube. A hot melt adhesive applicator 47 is preferably located downstream of the cylinder forming tunnel 46 to apply adhesive to mating outer edges of cylindrical web 20 to create seam 49. Other non-limiting methods could be used to create continuous or discontinuous seams, such as, ultrasonic bonding, heat sealing, and mechanical methods such as crimping sewing, stapling, taping and clipping. Additionally, two or more cylinder forming tunnels can be combined to create more than one seam 49. Such a combination can be useful for the production of large pleated products.

Figure 14:
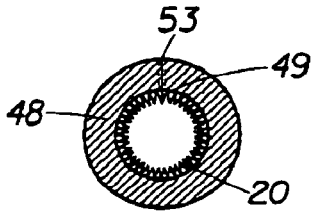

FIG. 14 shows a cross-section of the cylindrical pleated web 20 with seam 49 traveling through cooling tube 48. The cooling tube 48 preferably includes air jets 53 above seam 49 to cool seam 49 prior to cutting. Cooling tube 48 can support the formed cylinder and keep it at a controlled diameter. An inner core or vacuum canals can be included to prevent the cylindrical web from collapsing.

Referring to FIGS. 1 and 2, a saw 50 can be used to cut cylindrical web 20 into discrete cylindrical products 51. If cylindrical web 20 is in constant continuous motion, saw 50 should translate at a matched speed with web 20 during cutting. The preferred method of cutting is with circular saw blade, however a band saw or other cutting apparatus known to those skilled in the art can also be used. Sensors can measure the cut length obtained from the saw and this data can be used as feedback to adjust the speed of the drive rolls to maintain a constant product cut length. This can allow for compensation of gradual changes in roll pitch diameter due to wearing of the rollers.

The raw material does not necessarily need to be in continuous web form. Discrete, discontinuous sheets can be used in the pleating process. Additionally, this process can also be used to produce corrugated structures. In the instance where the folds are gradually radiused such as corrugations with a sinusoidal cross section, the cross section of the blades can be adjusted to yield an appropriate shape.

While particular embodiments of the present invention have been illustrated and described, it will be obvious to those skilled in the art that various changes and modifications may be made without departing from the spirit and scope of the invention. One skilled in the art will also be able to recognize that the scope of the invention also encompasses interchanging various features of the embodiments illustrated and described above. Accordingly, the appended claims are intended to cover all such modifications that are within the scope of the invention.

What is claimed is:

1. A web pleating apparatus having a mutually orthogonal machine direction, a cross machine direction and a Z-direction, the apparatus comprising:

a first series of elongate spaced protuberances converging in the cross-machine direction;

a second series of elongate spaced protuberances converging in the cross-machine direction;

a drive element disposed to form a friction nip with the first series of elongate spaced protuberances;

wherein said first series of protuberances and said second series of protuberances interleave in the Z-direction; and, said first series and said second series of interleaved protuberances being capable of folding a pleatable web into a generally pleated pattern of machine direction pleats upon contact of said web relative to said first and second series of protuberances.

2. The web pleating apparatus of claim 1 wherein said apparatus has a machine direction inlet to said first and second series of elongate spaced protuberances and said apparatus has a machine direction outlet from said first and second series of elongate spaced protuberances wherein said web maintains contact with said first series and said second series of interleaved protuberances from said inlet to said outlet.

3. The web pleating apparatus of claim 1 wherein said converging elongate spaced protuberances are blades.

4. The web pleating apparatus of claim 1 further comprising a converging tunnel disposed downstream in the machine direction of said first and second series of interleaved protuberances to receive said web and wherein said pleated web is constrained by said converging tunnel to maintain said pleated pattern when said web is within said converging tunnel.

5. The web pleating apparatus of claim 4 wherein said converging tunnel comprises an arcuate cavity for receiving said web.

6. The web pleating apparatus of claim 5, wherein said arcuate cavity has a radius, said radius being decreasable in said machine direction.

7. The web pleating apparatus of claim 1 further comprising a drive roll for pushing said pleatable web into said interleaved protuberances.

8. The web pleating apparatus of claim 7 wherein said first and second spaced protuberances have a first coefficient of friction and said drive roll has a second coefficient of friction and wherein said second coefficient of friction is greater than said first coefficient of friction.

9. The web pleating apparatus of claim 1 further comprising a heater for heating said pleated web.

10. The web pleating apparatus of claim 9 further comprising a cooler for cooling said web and being disposed downstream from said heater.

11. The web pleating apparatus of claim 1 further comprising a scoring device wherein said scoring device is capable of imparting indentations to said pleatable web prior to said pleatable web contacting said first and said second series of converging spaced protuberances and wherein said indentations are aligned with said first and said second series of converging elongate spaced protuberances.

12. The web pleating apparatus of claim 11 wherein said scoring device comprises first and second axially rotatable rolls having mutually parallel axes, each of said first and second rolls comprising inter-engaging corrugations for imparting said indentations upon said pleatable web.

13. The web pleating apparatus of claim 12 wherein said first and second rolls are constrained to maintain a fixed gap therebetween, said gap being less than the thickness of a pleatable web interposed between said first and second rolls during operation of said apparatus.

14. The web pleating apparatus of claim 1 wherein said first series of protuberances and said second series of protuberances are spaced apart in the cross-machine direction.

15. A method for forming a pleatable web comprising the steps of:

providing a pleatable web;

scoring said pleatable web in the machine direction;

transporting said scored web relative to a first series and second series of cross-machine direction converging elongate spaced protuberances interleaved in the Z-direction; wherein the scored web is transported by contact with a drive element, the drive element forming a friction nip with the first series of converging elongate spaced protuberances, the scored web passing through the friction nip, and, folding said scored web with said interleaved first series and second series of converging protuberances wherein said interleaved converging protuberances pleat said pleatable web in the machine direction.

16. The method of claim 15 further comprising the step of: forming said pleated web into an arcuate shape.

17. The method of claim 16 wherein said step of forming said web into an arcuate shape comprises the steps of:

providing a forming tunnel having a cross-section converging from a generally linear inlet to an outlet having a generally arcuate shape; and, inserting said web into said tunnel.

18. The method of claim 15 wherein said folding plastically deforms said pleatable web.

19. The method of claim 15 wherein the step of transporting said pleatable web relative to said interleaved first and second series of converging elongate spaced protuberances comprises pushing said pleatable web relative to said interleaved first and second series of converging elongate spaced protuberances.

20. The method of claim 15 further comprising the step of: heating said pleated web.

21. A web pleating apparatus having a mutually orthogonal machine direction, a cross-machine direction, and a Z-direction, the apparatus comprising:

a first series of non-collinear elongate spaced protuberances converging in the cross-machine direction;

a second series of non-collinear elongate spaced protuberances converging in the cross-machine direction;

a drive element disposed to form a friction nip with the first series of elongate spaced protuberances;

wherein said first series of protuberances and said second series of protuberances interleave in the Z-direction; and, said first series and said second series of interleaved protuberances being capable of folding a pleatable web into a generally pleated pattern of machine direction pleats upon contact of said web with said first and second series of protuberances.

22. The web pleating apparatus of claim 21 further comprising a drive roll for pushing said pleatable web into said interleaved protuberances.

23. The web pleating apparatus of claim 22, wherein said arcuate cavity has a substantially uniform radius.

24. The web pleating apparatus of claim 21 wherein said pleatable web has a first side and a second side opposed thereto, said first series of spaced protuberances contacting said first side and said second series of spaced protuberances contacting said second side when said pleatable web contacts said web pleating apparatus.

25. The web pleating apparatus of claim 24 further comprising a scoring device, wherein said scoring device is capable of imparting indentations to said pleatable web prior to said pleatable web contacting said first and second series of converging spaced protuberances and wherein said indentations are aligned with said first and second series of converging spaced protuberances.

26. A web pleating apparatus having a mutually orthogonal machine direction, a cross-machine direction, and a Z-direction, the apparatus comprising:

a first series of collectively elongate spaced protuberances converging in the cross-machine direction;

a second series of collectively elongate spaced protuberances converging in the cross-machine direction;

a drive element disposed to form a friction nip with the first series of elongate spaced protuberances;

wherein said first series of protuberances and said second series of protuberances interleave in the Z-direction; and, said first series and said second series of interleaved protuberances being capable of folding a pleatable web into a generally pleated pattern of machine direction pleats upon contact of said web within said first and second series of protuberances.

* * * * *

UNITED STATES PATENT AND TRADEMARK OFFICE

CERTIFICATE OF CORRECTION

PATENT NO. : 7,963,899 B2
APPLICATION NO. : 09/905274
DATED : June 21, 2011
INVENTOR(S) : Clifford Theodore Papsdorf et al.

It is certified that error appears in the above-identified patent and that said Letters Patent is hereby corrected as shown below:

Title Page, item (73)

Listed under Assignee: delete "Proctor" and insert --Procter--.

Column 3

Line 24, delete "44" and insert --4-4--.

Signed and Sealed this
Ninth Day of August, 2011

David J. Kappos

David J. Kappos
*Director of the United States Patent and Trademark Office*